US012075911B2

(12) United States Patent
Rehage et al.

(10) Patent No.: US 12,075,911 B2
(45) Date of Patent: Sep. 3, 2024

(54) DEVICE FOR THE TRANSLATORY AND ROTARY MOVEMENT OF AN ITEM RELATIVE TO A CARRIER PANEL

(71) Applicant: PAUL HETTICH GMBH & CO. KG, Kirchlengern (DE)

(72) Inventors: Daniel Rehage, Münster (DE); Eduard Arnst, Lemgo (DE); Andreas Matthes, Chemnitz (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 247 days.

(21) Appl. No.: 17/802,593

(22) PCT Filed: Feb. 4, 2021

(86) PCT No.: PCT/EP2021/052686
§ 371 (c)(1),
(2) Date: Aug. 26, 2022

(87) PCT Pub. No.: WO2021/170365
PCT Pub. Date: Sep. 2, 2021

(65) Prior Publication Data

US 2023/0091155 A1 Mar. 23, 2023

(30) Foreign Application Priority Data

Feb. 27, 2020 (DE) ..... 10 2020 105 202.2

(51) Int. Cl.
*A47B 96/02* (2006.01)
*A47B 49/00* (2006.01)

(52) U.S. Cl.
CPC ..... *A47B 96/025* (2013.01); *A47B 49/004* (2013.01)

(58) Field of Classification Search
CPC ..... A47B 96/025; A47B 49/004; A47B 91/06; A47B 49/006; A47B 77/10; A47B 88/48;
(Continued)

(56) References Cited

U.S. PATENT DOCUMENTS 2,650,871 A 9/1953 Holderegger
4,124,262 A * 11/1978 Schill ..... A47B 49/004 312/307

(Continued)

FOREIGN PATENT DOCUMENTS

DE 102017106170 A1 9/2018
DE 102018108977 A1 10/2019

(Continued)

OTHER PUBLICATIONS

International Search Report mailed Apr. 13, 2021 in related/corresponding International Application No. PCT/EP2021/052686.

(Continued)

*Primary Examiner* — Hiwot E Tefera
(74) *Attorney, Agent, or Firm* — PATENT PORTFOLIO BUILDERS PLLC

(57) ABSTRACT

A device for the rotary movement has a planar bearing region relative to a bearing region of a carrier panel. The bearing region is arranged in a plane-parallel state in relation to the bearing region. As seen in the plane of the bearing surfaces, a length of the item is greater than a width of the item. Mutually facing bearing surfaces of the bearing regions have respective running channels, in which rolling-contact bodies are guided. The running channels are formed such that the item is moveable relative to the carrier panel from a starting position into an end position, in which the item has been pivoted through a predetermined angle of between 130° and 180° relative to the carrier panel and can be pivoted in a pivoting direction back into the starting (Continued)

Figure 1:
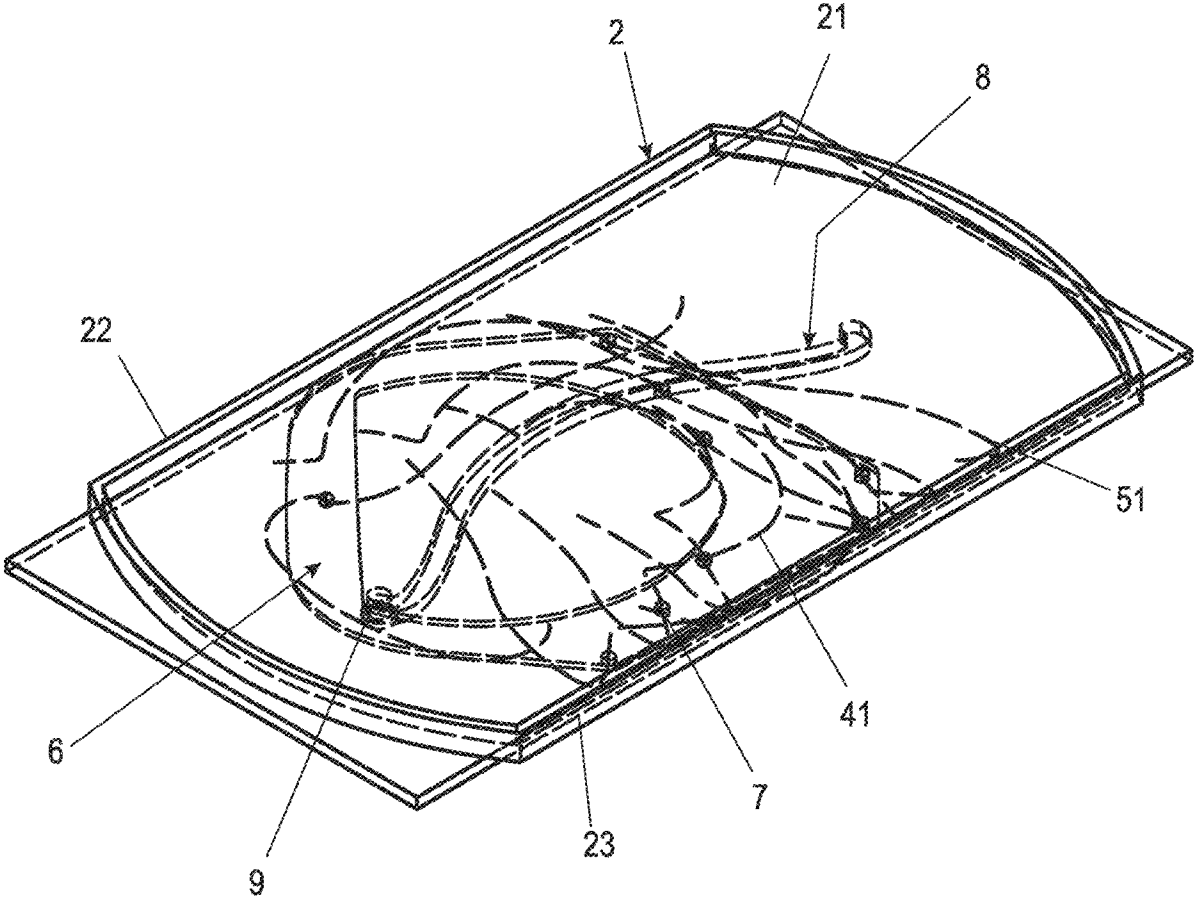

position. A connecting stub projects out from one of the bearing regions and is moveable in a guide track arranged in the other of the two bearing regions. The guide stub is arranged eccentrically on one of the bearing regions and the guide track is in the form of a curve with a varying radius of curvature.

12 Claims, 13 Drawing Sheets

(58) Field of Classification Search
CPC ..... A47B 46/00; F25D 11/00; F25D 25/027; F25D 25/02; F25D 25/021
See application file for complete search history.

(56) References Cited

U.S. PATENT DOCUMENTS

| | | | | |
|---|---|---|---|---|
| 4,582,372 | A | 4/1986 | Cooper | |
| 6,481,586 | B1 | 11/2002 | Hoff | |
| 7,147,445 | B2 * | 12/2006 | Krayer | A47B 49/006 108/103 |
| 11,000,124 | B2 * | 5/2021 | Rehage | A47B 96/025 |
| 11,098,758 | B2 * | 8/2021 | Rehage | A47B 96/025 |
| 11,333,430 | B2 | 5/2022 | Rehage et al. | |
| 11,350,745 | B2 * | 6/2022 | Rehage | A47B 96/025 |
| 2002/0117943 | A1 * | 8/2002 | Gerkey | A47B 96/025 312/238 |
| 2020/0018349 | A1 * | 1/2020 | Rehage | A47B 77/10 |
| 2020/0187641 | A1 * | 6/2020 | Rehage | F25D 25/027 |
| 2021/0156609 | A1 * | 5/2021 | Rehage | F25D 25/021 |
| 2021/0227974 | A1 * | 7/2021 | Rehage | A47B 96/025 |

FOREIGN PATENT DOCUMENTS

| | | | |
|---|---|---|---|
| DE | 102018116210 | A1 | 1/2020 |
| WO | 2003060403 | A1 | 7/2003 |

OTHER PUBLICATIONS

Search Report created Sep. 4, 2020 in related/corresponding DE Application No. 10 2020 105 202.2.
Written Opinion mailed Apr. 13, 2021 in related/corresponding International Application No. PCT/EP2021/052686.

* cited by examiner

DEVICE FOR THE TRANSLATORY AND ROTARY MOVEMENT OF AN ITEM RELATIVE TO A CARRIER PANEL

BACKGROUND AND SUMMARY OF THE INVENTION

Exemplary embodiments of the present invention relate to a device for the translatory and rotary movement of an item having a planar bearing region relative to a bearing region of a carder panel arranged plane-parallel in relation to the bearing region, as well as to a piece of furniture or household appliance, A generic device is known, for example, from DE 10 2017 106 170 A1, In DE 10 2017 106 170 A1, a translational-rotational bearing is used to perform a translatory and rotary movement, which essentially has two panels with running channels formed thereon in which rolling bans are guided. The running channels are designed in such a way that they allow translatory and rotary movement of one plate relative to the other plate by a predetermined angle.

A rectilinear slot provided in one of the plates, in which a connecting stub attached to the other plate is guided, also allows translatory movement, as well as axial fixation of the panels relative to each other, A problem with this design in connection with a large difference between the length and with of the item is the generation of tipping forces when the item is in or near the 90° pivoted position, hi which the item protrudes maximally over a front edge of the carder panel. In this case, the item may preferably be in the form of a shelf.

This means that there is a risk of the shelf tipping over the edge of the carrier panel, especially when heavier items are placed on the part of the shelf that protrudes over this edge, Exemplary embodiments. of the present invention are directed to further developing a device for the translatory and rotatory movement of an item having a flat bearing region relative to a bearing region of a carrier panel arranged plane-parallel to the bearing region, in which bearing surfaces of the bearing regions facing one another have respective running channels in which rolling-contact bodies are guided, to the effect that tilting forces occurring even with minimal overlap of the item with respect to the carrier panel can be better absorbed.

The device according to the invention, in which, as viewed in the plane of the bearing surfaces, a length of the item is greater than a width of the item, has, on bearing surfaces facing one another of the bearing regions, respective running channels in which rolling-contact bodies are guided, The running channels are shaped such that when force is applied to the item in a direction defined in the plane of the bearing region, the item is movable relative to the carrier panel in a first pivoting direction from a starting position to an end position in which the item is pivoted relative to the carrier panel through a predetermined angle of between 90° and 180° and is pivotable back to the starting position in a pivoting direction opposite to the first pivoting direction.

A connecting stub protrudes from one of the bearing regions and is movable in a guide track arranged in the other of the bearing regions.

The connecting stub is arranged eccentrically on one of the bearing regions, The guide track is arc-shaped with a varying radius of curvature.

With a device designed in this way, the off-centers arrangement of the connecting stub in particular makes it possible to form a larger lever arm for absorbing the tipping forces that occur compared to a centrally arranged connecting stub.

This makes it possible, in particular, to use items with a greater aspect ratio, The aspect ratio is defined as the ratio of the length to the width of the item in the plane of the bearing regions.

Rotation by a total of 180° enables an item with a greater length than width to be inserted congruently in both layers into a piece of furniture or household appliance or other items.

Thus, the effect of supporting the resulting tilting forces in such a device with an unequal ratio of the length and width of the item is greatest when the rotation is 90°.

Due to the off-center arrangement of the connecting stub, the formation of the lever arm for absorbing occurring tilting forces is greatest when rotating by 90° compared to a centrally arranged connecting stub.

The device for translatory and rotary movement of the item can therefore also be pivoted by only 90°, for example, so that the enlarged support effect according to the invention acts against tipping. An alternative device may thus have a smaller total angle of rotation than 180°, for example only 90°.

The bearing of the item via the rolling-contact bodies guided in the running channels also reduces manufacturing costs and increases the robustness and ease of operation with little effort of the device.

According to an advantageous embodiment variant, a distance of the connecting stub to opposite longitudinal edges of the item is equal, in other words, the connecting stub is arranged off-center in the direction of the longitudinal extension of the item. and centered in the bearing region of the item in the direction of the width extension of the item.

According to a preferred further development, the connecting stub has a cylindrical neck region, from the free end of which a collar extends, the surface of which facing the neck region engages behind a support surface formed in the guide track.

The positive connection thus achieved between the item and the carder panel in a direction perpendicular to the plane of the bearing regions allows further improved absorption of tipping forces.

Particularly preferably, side edges of a curved path of the guide track connecting the ends are formed with respective support surfaces.

According to an advantageous further development, a plurality of spaced-apart support webs aligned perpendicular to the plane of the bearing surfaces are integrally formed with a respective support surface on the inner edges of the ends of the guide track.

According to a further preferred embodiment variant, at least one spring tongue is formed on each of the inner edges of the ends of the guide track, which tongue can be pressed under the action of force from a latching position narrowing a passage width of the guide track in the direction of the guide track edge, wherein the spring tongue is integrally formed at the level of the neck region of the connecting stub, as viewed perpendicularly to the plane of the bearing surfaces.

This provides simple haptic feedback for the user that the item has reached its final position.

According to a further preferred embodiment variant, the curved path of the guide track is curved in only one direction.

Particularly preferably, the ends of the guide track in the transition area to the curved path are curved in the opposite direction to the curvature of the curved path.

According to a further advantageous embodiment variant of the invention, the rolling-contact bodies are accommodated in a rolling-contact body cage having a plurality of rolling-contact body receptacles.

Particularly preferably, the rolling-contact body cage has an annular, closed frame region and a support region. The frame region does not extend beyond an edge of the carrier panel in any position of the item from the starting position to the end position, so that rolling-contact bodies mounted in this part of the rolling-contact body cage always transmit a partial load of the item to the carrier panel. The support region extends beyond an edge of the carrier panel within a predetermined pivot angle range, thus helping to further support the item against tipping over the edge of the carrier panel.

As a result, the rolling-contact body cage also contributes to further stabilization with regard to any tipping forces that occur.

According to a preferred embodiment variant, the item is formed as a shelf with a storage surface.

The piece of furniture or household appliance according to the invention, in particular refrigerator or freezer, has a body on which at least one item described as above is arranged.

BRIEF DESCRIPTION OF THE DRAWING FIGURES

Figure 2:
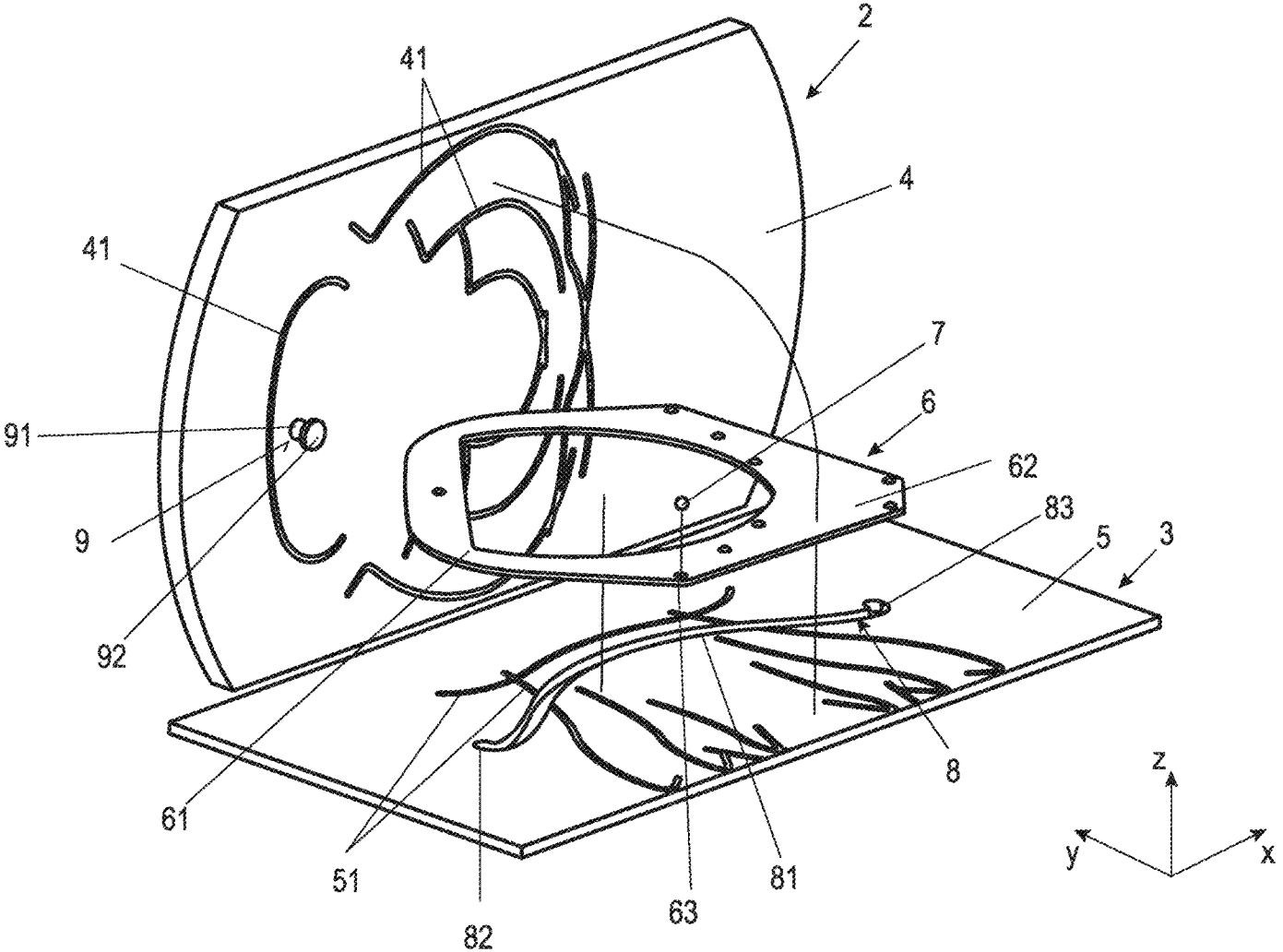
Figure 3:
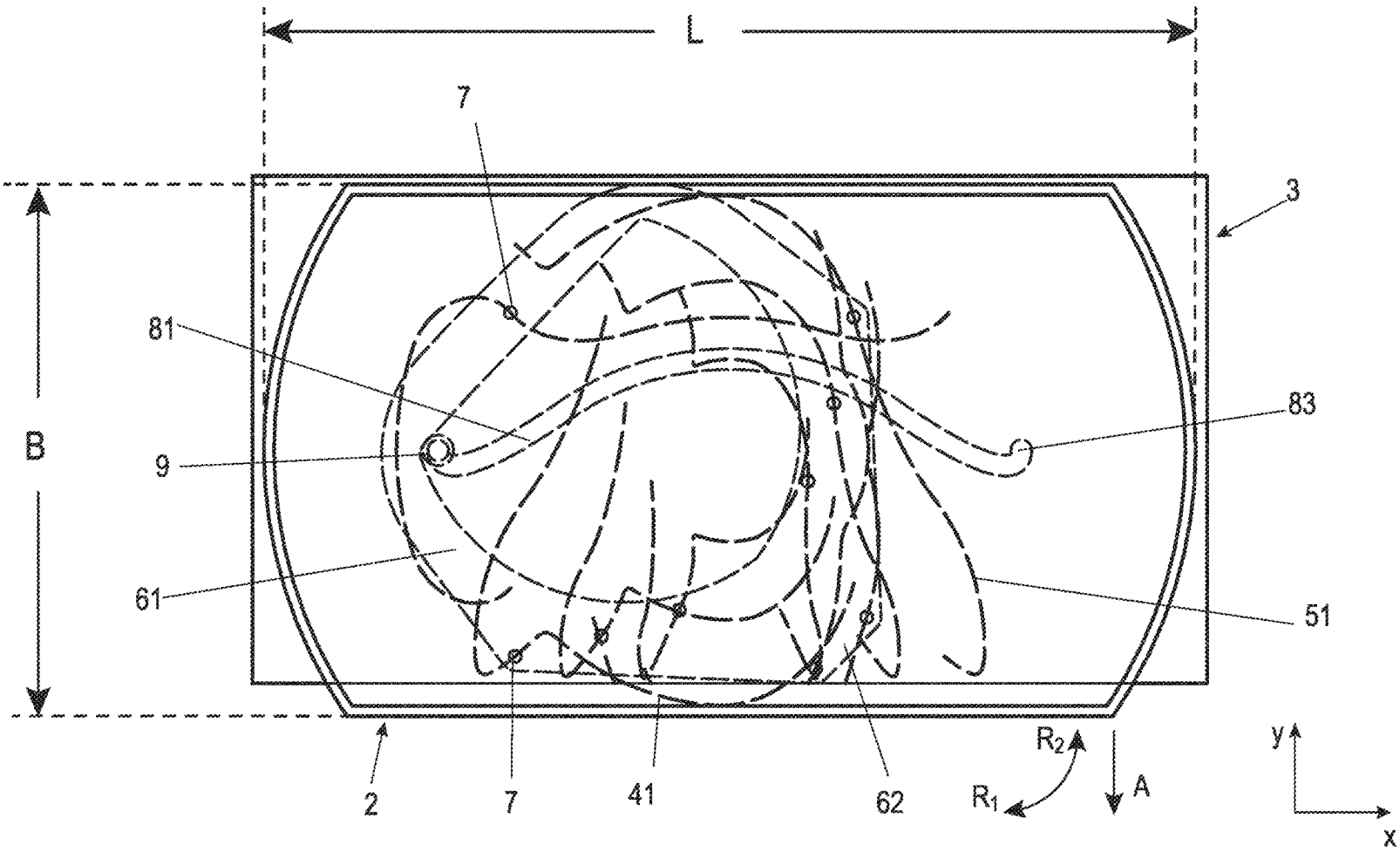
Figure 4:
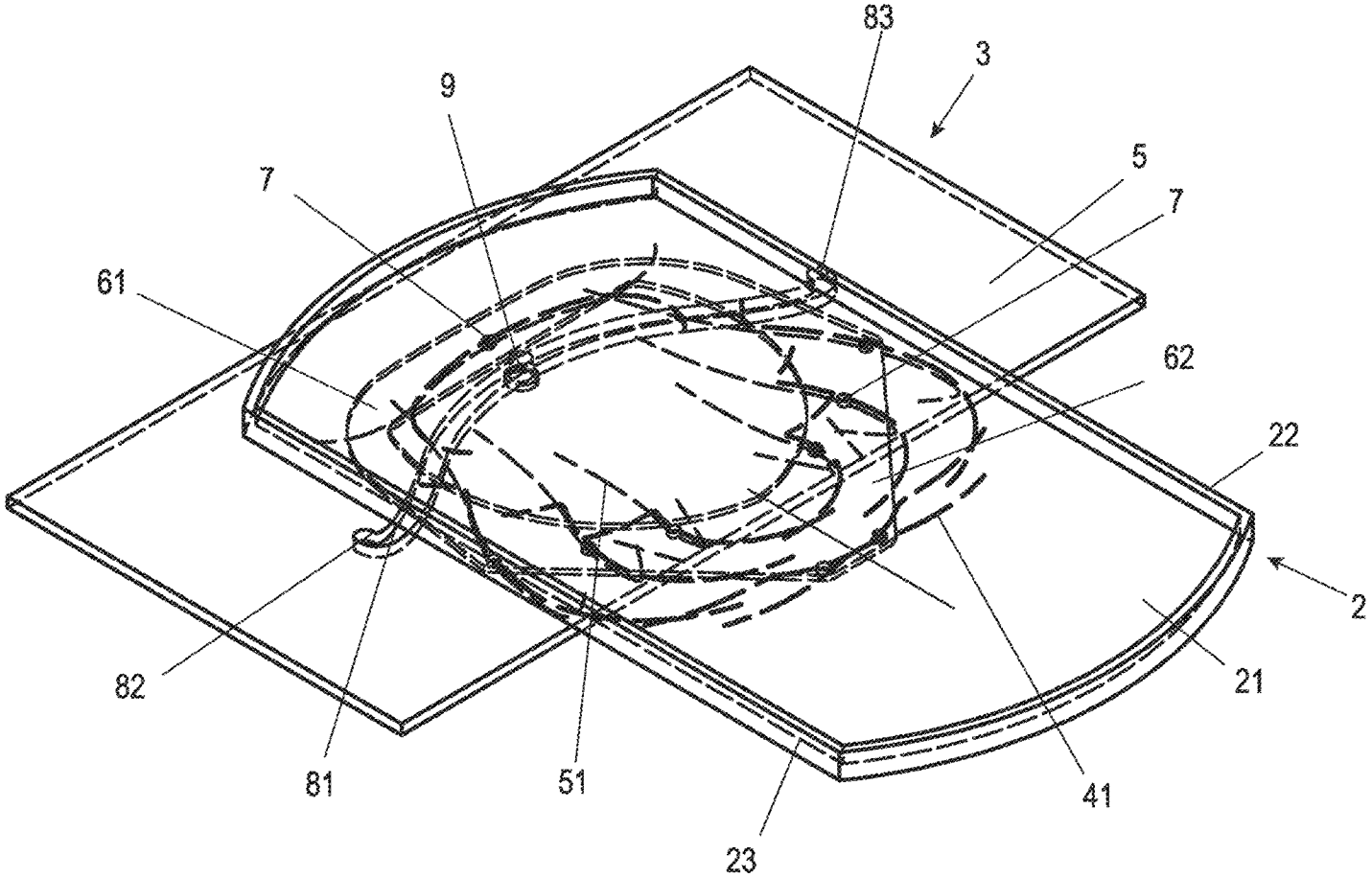
Figure 5:
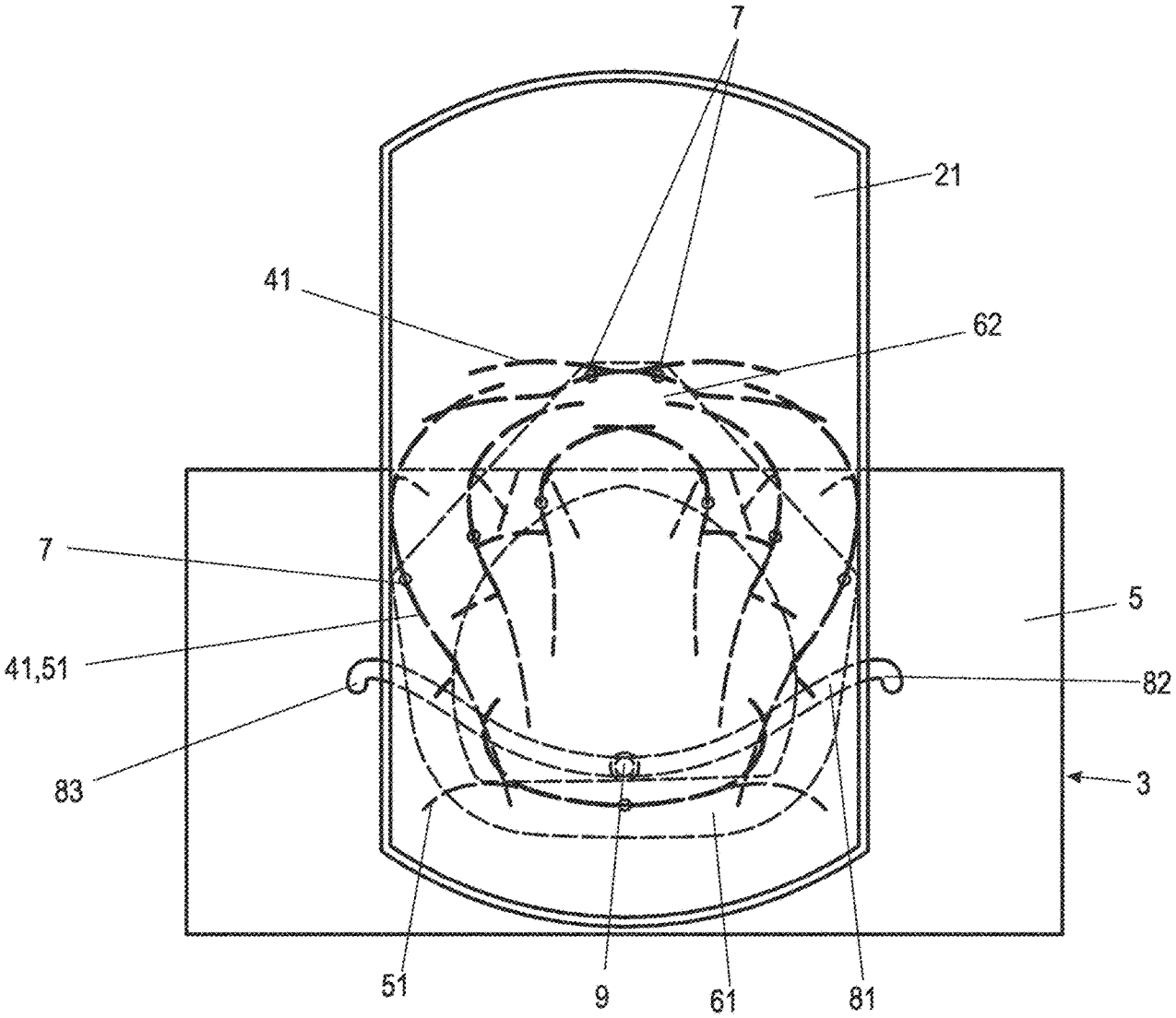

Preferred exemplary embodiments are explained in more detail below with reference to the accompanying drawings, wherein:

FIG. 1 shows an isometric representation of an embodiment variant of the invention in a starting position, FIG. 2 shows an isometric exploded view of the device shown in FIG. 1, FIG. 3 shows a top view of the device shown in FIG. 1, FIG. 4 shows a representation of the device corresponding to FIG. 1, with the item pivoted by 90°, FIG. 5 shows an illustration corresponding to FIG. 3 with the item pivoted by 90°.

Figure 6:
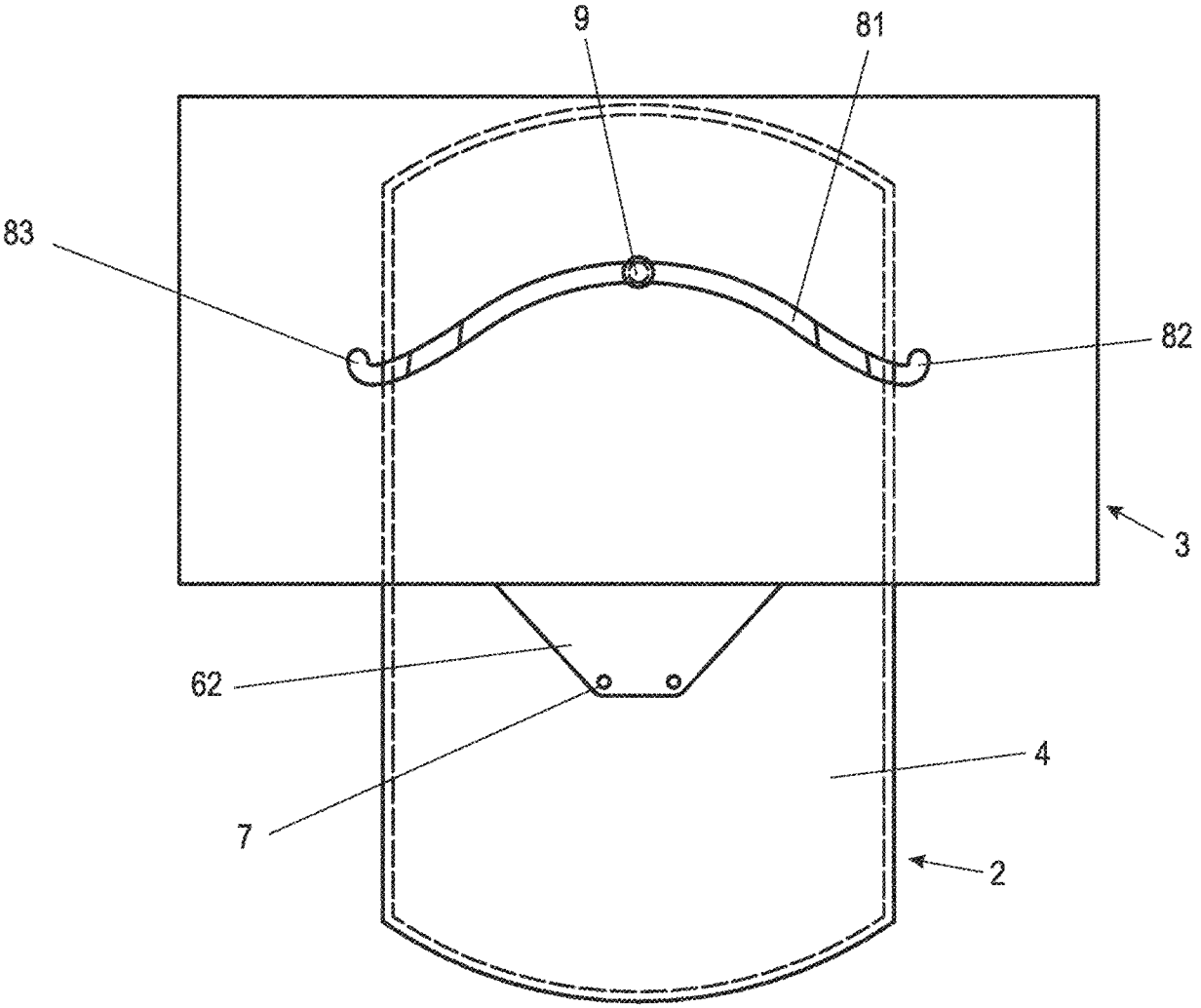

FIG. 6 shows a view from below with the item pivoted by 90°.

Figure 7:
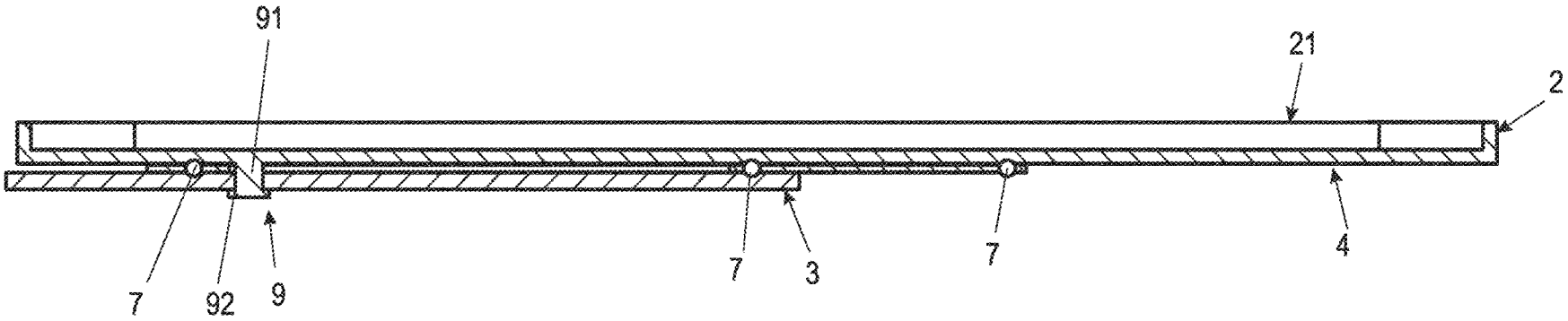
Figure 8:
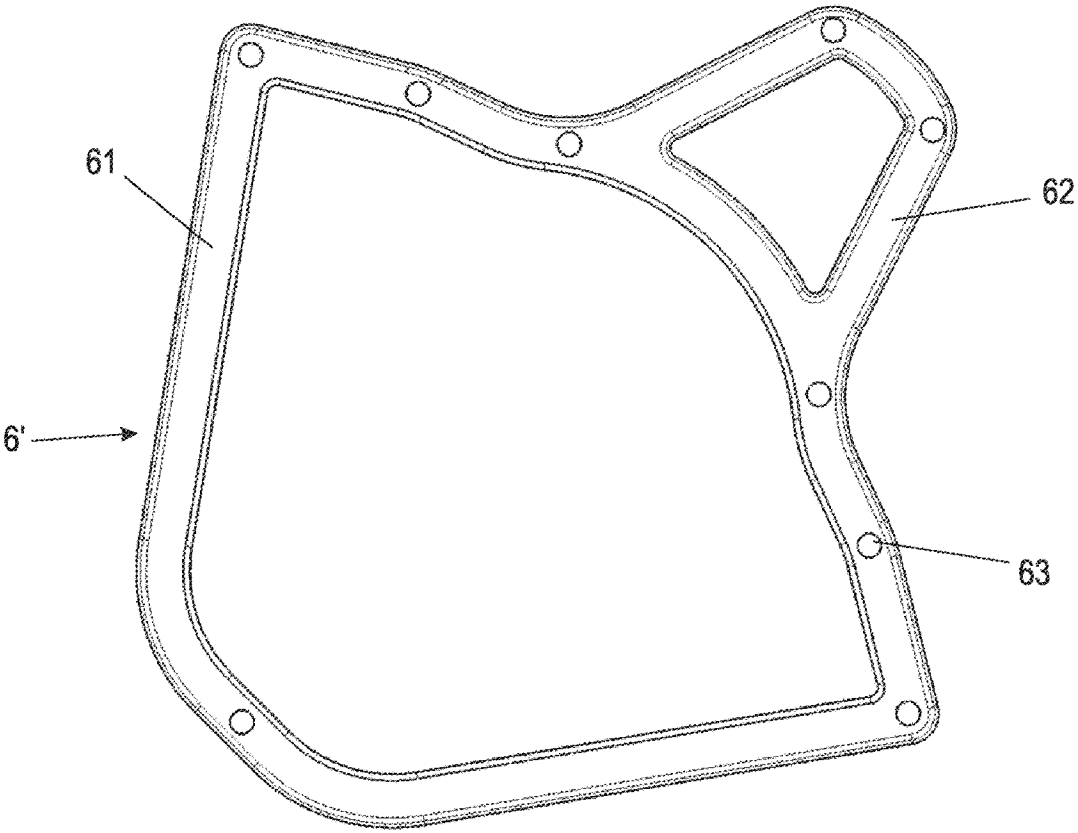
Figure 9:
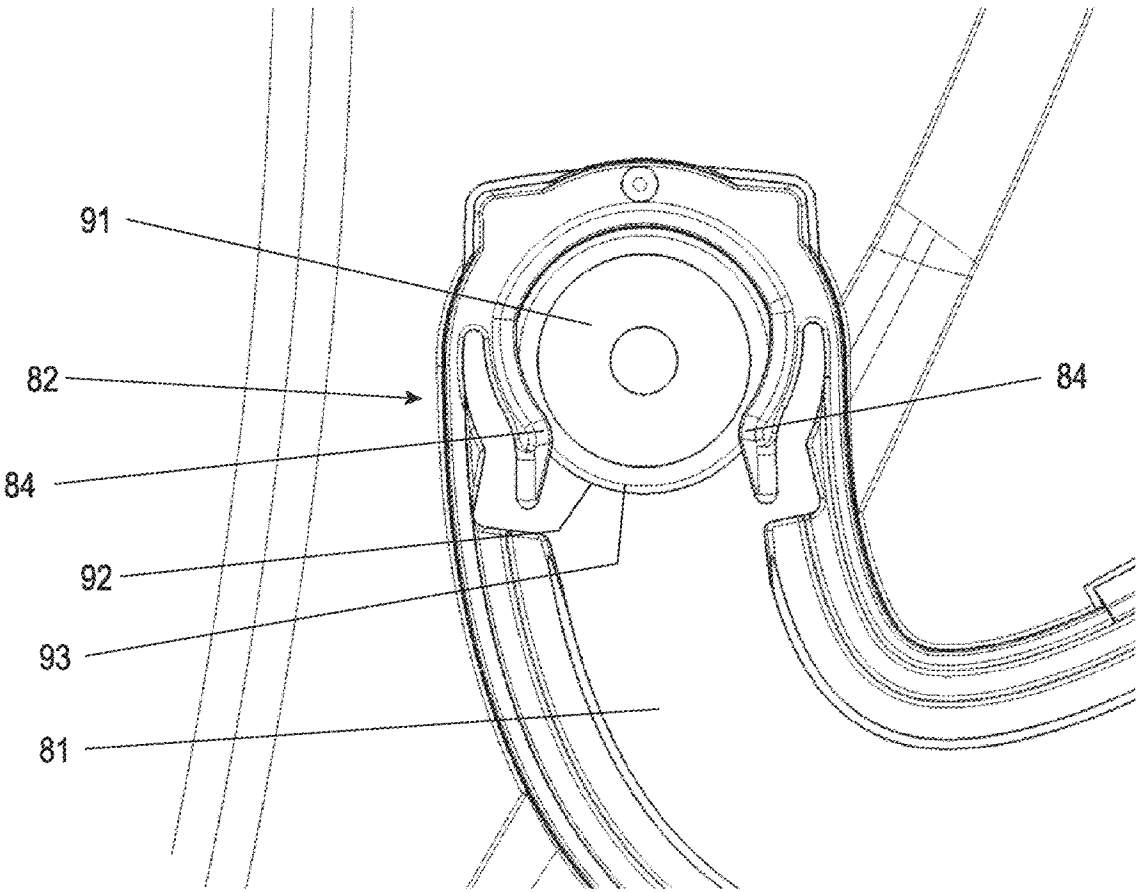
Figure 10:
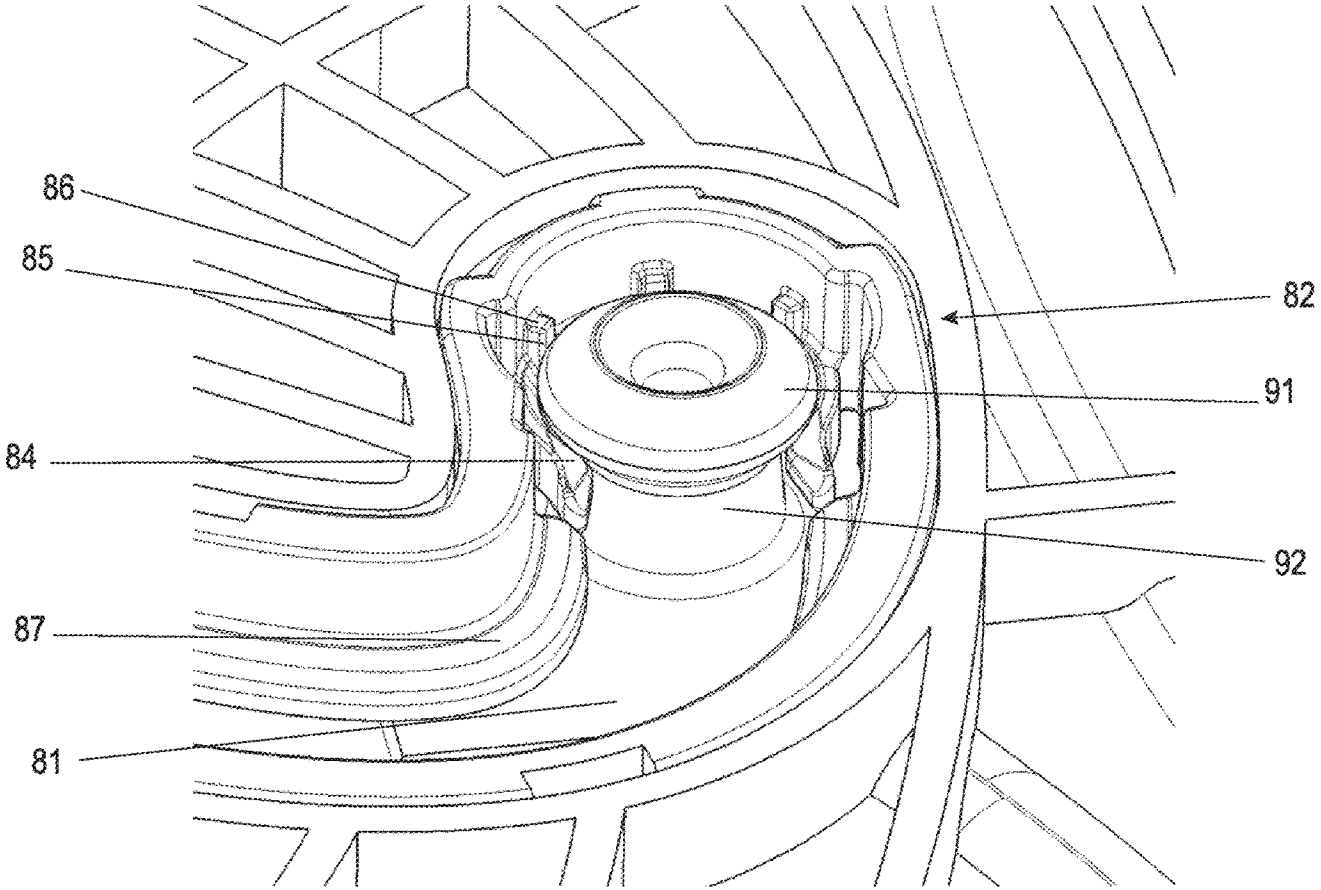
Figure 11:
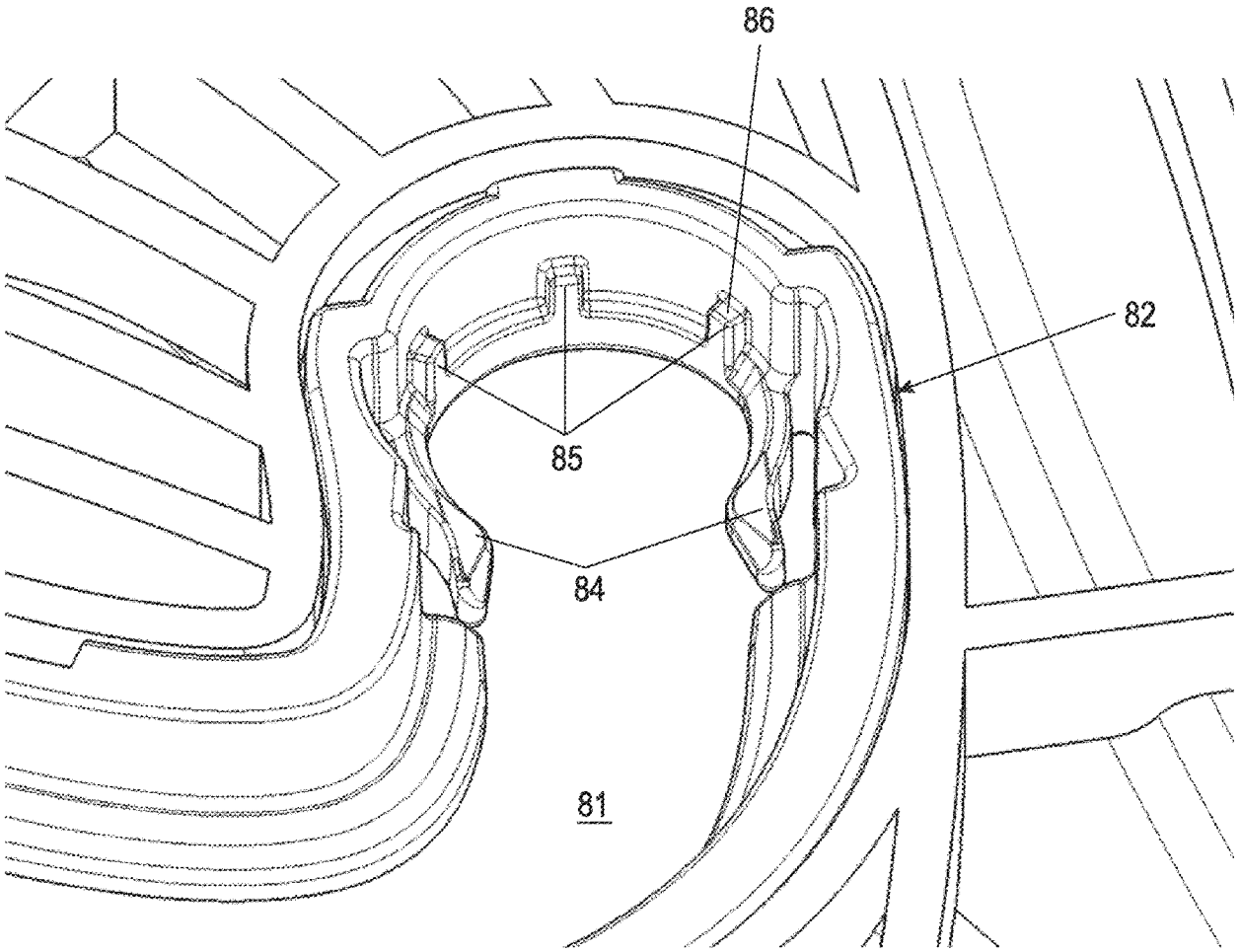
Figure 12:
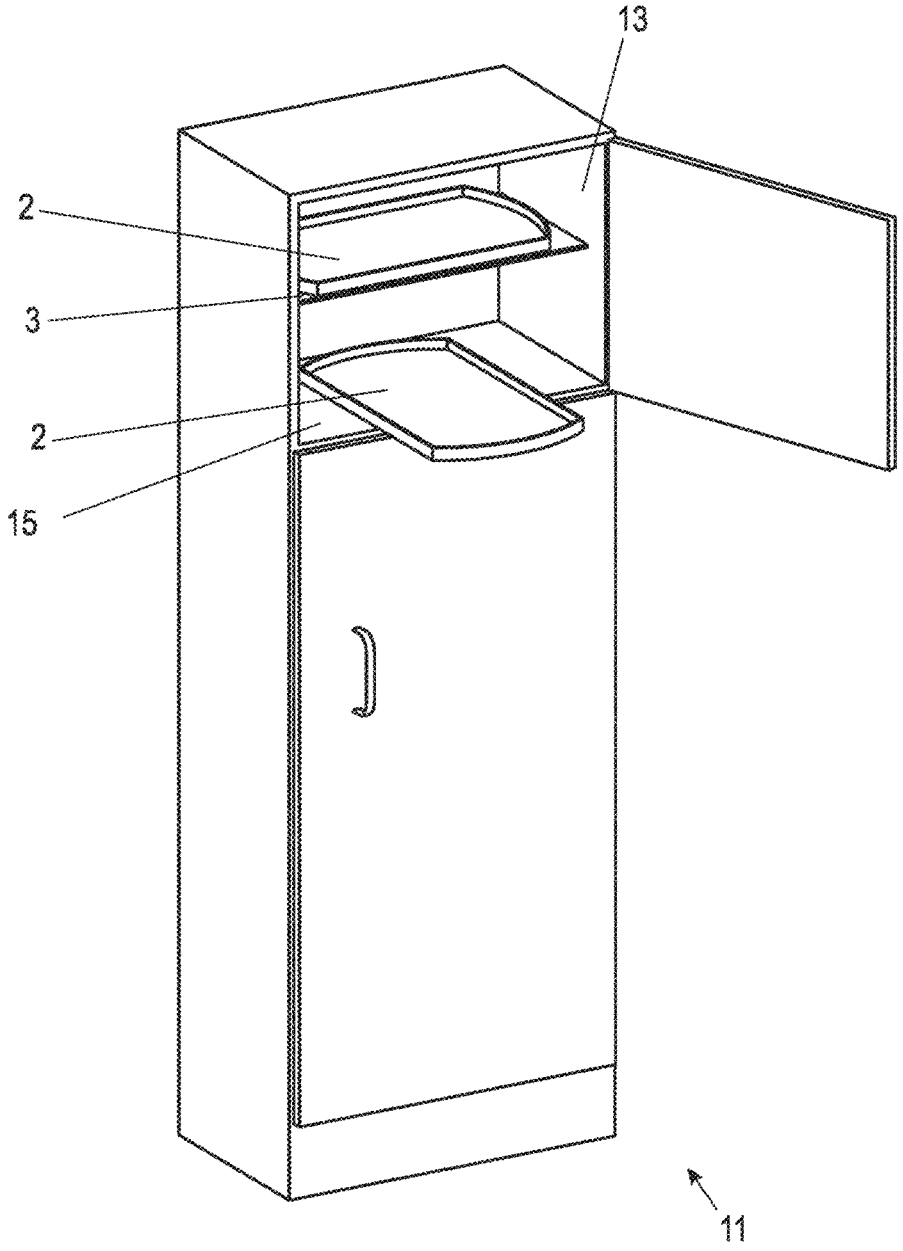
Figure 13:
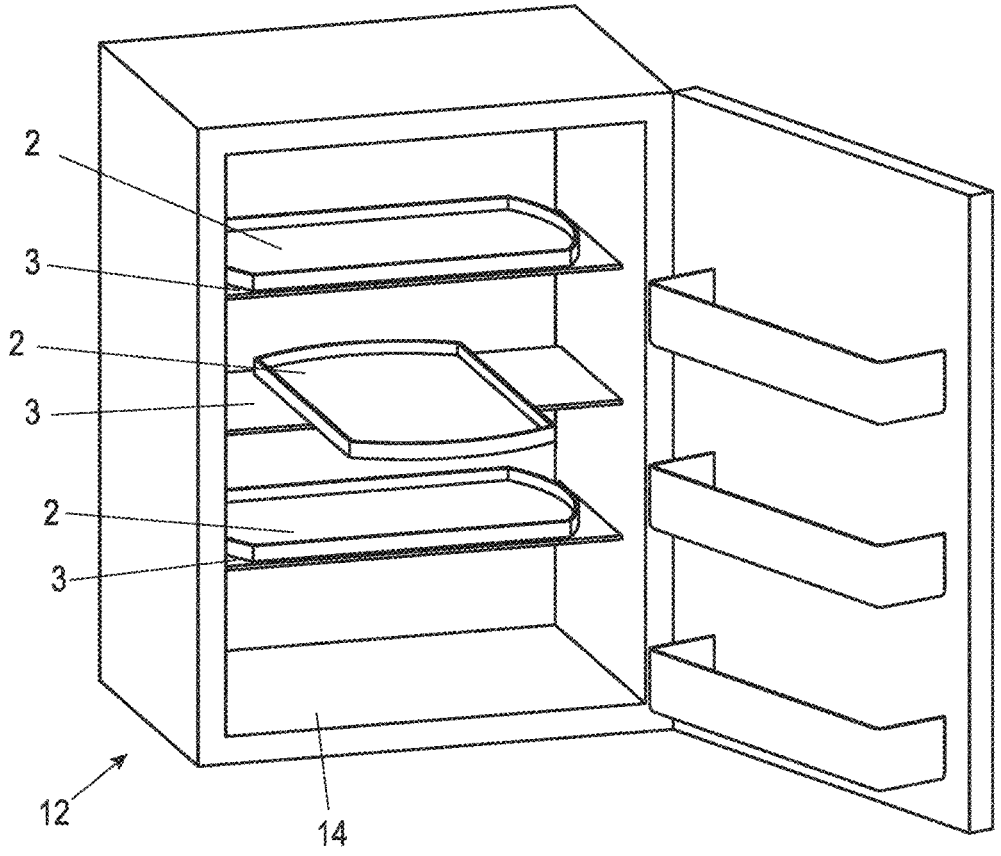

FIG. 7 shows a side section view of the device in the orientation shown in FIG. 4, FIG. 8 shows a top view of an alternative embodiment variant of a roiling-contact body cage, FIG. 9 shows a detailed view of one end of the guide track with spring tongues and support surfaces formed in this area, FIG. 10 shows a view of the end of the guide track shown in FIG. 9 from below with the connecting stubs retracted in the end, FIG. 11 shows an isometric view of the end of the guide track corresponding to FIG. 10 without the connecting stub retracted, and FIGS. 12 and 13 show respective isometric exemplary views of a piece of furniture or household appliance with device mounted therein.

DETAILED DESCRIPTION in the following description of figures, terms such as top, bottom, left, right, front, rear, etc. refer exclusively to the exemplary representation and position of the item, the carder panel, the rolling-contact bodies, the rolling-contact body cage, the guide track, the connecting stubs and the like selected in the respective figures. These terms are not to be understood restrictively, i.e., due to different working positions or the mirror-symmetrical design or the like, these references may change.

In FIG. 1, the reference sign 2 designates an item which is preferably designed as a shelf and which is mounted on a carrier panel 3 so as to be simultaneously translationally and rotationally movable about a connecting stub 9, which serves as a pivot axis and is movable along an arcuately designed guide track 8.

Simultaneous translatory and rotary movement is understood here as a superposition of a rotational movement of the item around the connecting stub and a translational movement of the item with the connecting stub along the guide track.

The underside of the item 2 designed as a shelf and the upper side of the carrier panel 3 are designed as bearing regions 4, 5. The bearing surfaces of these bearing regions 4, 5 facing each other each have running channels 41, 51 in which roiling-contact bodies 7, preferably in the form of balls, are guided.

The running channels 41, 51 introduced into the bearing regions 4, 5 of the item 2 and the carder panel 3 are designed and introduced distributed over the bearing regions 4, 5 in such a way that several of the rolling-contact bodies 7, when force is applied to the item 2 in a direction A defined in the plane of the bearing regions, move the item 2 in a positively guided translatory and rotatory movement from a starting position, shown by way of example in FIG. 3, into an intermediate position pivoted by 90°, as shown by way of example in FIG. 5, up to an end position pivoted by a further 90°, in which the item 2 is pivoted relative to the carder panel 3 by a total of 180° in a first pivoting direction $R_1$.

Designs of the running channels 41, 51 are also conceivable in such a way that the item 2 can be moved from a starting position into an end position pivoted by less than 180° in a first pivoting direction $R_1$, wherein the end position is reached during a rotation of the item 2 from its starting position by at least 90°, preferably between 130° and 180°.

Furthermore, the running channels 41, 51 are designed in such a way that the item 2, during its pivoting movement, only passes over a front edge (in FIG. 3) of the carrier panel 3, in order to be able to install such a device, for example, in a storage compartment of a piece of furniture 11 or household appliance 12 which is laterally enclosed from three skies, as exemplified in FIGS. 12 and 13.

Furthermore, the item 2 can be pivoted from this end position in a pivoting direction $R_2$ opposite to the first pivoting direction $R_1$ back to the starting position.

As can further be seen from FIGS. 1 to 3, when viewed in the plane of the bearing surfaces, a length L of the item 2 is significantly greater than a with B of the item 2.

As can be seen further in FIG. 2. the connecting stub 9 protrudes from the bearing region 4 of the item 2.

In the assembled state of the item 2, the connecting stub 9 is movable on the carrier panel 3 in a guide track 8 arranged in the bearing region 5 of the carrier panel 3.

The receiving width of the guide track 8 can be larger than the diameter of the part of the connecting stub 9 projecting into the guide track 8. This enables a play of the connecting stub 9 in the guide track that goes beyond structural tolerances, Furthermore, as can be clearly seen in FIG. 2, the connecting stub 9 is arranged off-center on the bearing region 4 of the item 2. Therefore, the rotational portion of the item 2 is explained here throughout as a pivoting movement.

In the present exemplary embodiment, the connecting stub 9 is positioned such that it protrudes off-center from the bearing region 4 of the item 2 in the direction of the longitudinal extension L of the item 2 and in the direction of the width extension Bin the center, Therefore, a distance of the connecting stub 9 to opposite longitudinal edges 22, 23 of the item 2 is equal.

The curved guide track 8 is designed with a varying radius of curvature. The guide track 8 essentially consists of a curved path 81, which is preferably curved in only one direction, from which respective ends 82, 83 extend, which are curved in the transition to the curved path 81 in the opposite direction to the curvature of the curved path 81.

For positive connection of the carder panel 3 to the item 2, the connecting stub 9 has a cylindrical neck region 91, from the free end of which extends a collar 92, the surface 93 of which facing the neck region 91 engages behind a support surface 86, 87 formed in the guide track 8. The support surfaces 86, 87 are shown by way of example in FIG. 10.

As can be seen further in FIGS. 9-11, which show one of the ends 82, 83 of the guide track 8 in detail, the side edges of a curved path 81 of the guide track 8 connecting the ends 82, 83 to one another are formed with respective support surfaces 86, against which the surface 93 of the collar 92 rests in an end position without play in the event of acting tilting forces.

Other support surfaces 86 are formed on the inner edges of the ends 82, 83 of the guide track 8 spaced apart from each other, wherein the support webs 85 are oriented perpendicularly to the plane of the bearing surfaces, as can be readily seen in FIGS. 10 and 11.

Furthermore, at least one spring tongue 84 is formed on each of the inner edges of the ends 82, 83 of the guide track 8, which can be pressed towards the edge of the guide track under the action of force from a latching position of the connecting stub 9 narrowing a passage width of the guide track 8.

The spring tongue 84 is formed perpendicularly to the plane of the bearing surface at the level of the neck region 91 of the connecting stub 9.

In the preferred embodiment variant shown here, two such spring tongues 84 are provided, which are forced apart when the connecting stub 9 enters one of the ends 82, 83 and hold the connecting stub 9 in this end position after it has been fully retracted into the end position, so that it is only possible for the connecting stub 9 to slide out of this end position by applying a predetermined force that is sufficient to force the spring tongues 84 apart.

As shown in particular in FIGS. 2 and 8, the rolling-contact bodies 7 are received in a rolling-contact body cage 6 with a plurality of rolling-contact body receptacles 63 and are captively retained therein.

The two slightly differently designed embodiment variants of rolling contact body cages 6 essentially comprise an annular, dosed frame region 61 and a support region 62.

In this regard, the frame region 61 is shaped and positioned between the bearing regions 4, 5 such that it does not protrude beyond an edge of the carrier panel 3 in any pivoted position, as exemplified by FIGS. 1, 3, 4 and 5.

In contrast, the support region 62 of the rolling-contact body cage 6 extends beyond an edge of the carrier panel 3 for additional absorption of tilting forces within a predetermined pivot angle range of the item 2 relative to the carrier panel 3.

As shown, for example, in FIG. 4 and FIG. 7, in which the item 2 designed here as a shelf has a minimum overlap with the carder and 3 or projects at most beyond a front edge of the carder panel 3, in this pivoted position of the item 2 the support region 62 is arranged under the item 2 in such a way that it is additionally able to absorb tilting forces.

FIGS. 12 and 13 show a preferred application of the above-described device in a piece of furniture 11 (FIG. 12) or a household appliance 12 designed as a refrigerator or freezer, in which the item 2 with the carder panel 3 is arranged in a body 13, 14 of the piece of furniture or household appliance.

In this case, a stationarily fixed base 15 is preferably arranged in the body 13, 14 of the piece of furniture 11 or household appliance 12, on which the carder panel 3 of the device is fixed. It is also conceivable to fasten the carder panel directly to the body 13, 14.

It is also conceivable that an item according to the invention and a carder panel according to the invention are used in the interior of a motor vehicle, for example a caravan or in the cockpit or trunk of a car.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also dear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

2 Item
21 Depositing surface
22 Longitudinal edge
23 Longitudinal edge
3 Carder panel
4 Bearing region
41 Running channel
42 Bearing plate
5 Bearing region
51 Running channel
6 Rolling-contact body cage
61 Frame region
62 Support region
63 Rolling-contact body receptacle
7 Rolling-contact body
8 Guide track
81 Curved path
82 End
83 End
84 Spring tongue
85 Support web
86 Support surface
87 Support surface
9 Connecting stub
91 Neck
92 Collar

93 Surface
11 Piece of furniture
12 Household appliance
13 Body
14 Body
15 Base
A Direction
$R_1$ Pivoting direction
$R_2$ Pivoting direction
Length
B Width
X Direction
Y Direction
Z Direction

The invention claimed is:

1. A device, comprising:

a carrier panel having a bearing region;

an item configured for translatory and rotary movement, wherein the item has a flat bearing region relative to the bearing region of the carrier panel, wherein the bearing region of the carrier panel is arranged plane-parallel to the flat bearing region of the item, wherein the flat bearing region of the item and the bearing region of the carrier panel have mutually facing bearing surfaces, wherein, as viewed in a plane of the bearing surfaces of the item and the carrier panel, a length of the item is greater than a width of the item, wherein the mutually facing bearing surfaces of the bearing regions of the item and carrier panel have respective running channels in which rolling-contact bodies are guided, wherein the running channels are formed in such a way that when force is applied to the item in a direction defined in the plane of the bearing regions of the item and the carrier panel, the item is moveable relative to the carrier panel in a first pivoting direction from a starting position into an end position, in which the item is pivoted relative to the carrier panel through a predetermined angle between 90° and 180° and is pivotable back into the starting position in a second pivoting direction, which is opposite to the first pivoting direction, wherein a connecting stub projects from one of the bearing regions of the item and the carrier panel and is movable in a guide track arranged in the other of one of the bearing regions of the item and the carrier panel, wherein the connecting stub is arranged eccentrically on the one of the bearing regions from which it projects, wherein the guide track forms a curve with a varying radius of curvature, and wherein the connecting stub has a cylindrical neck region, from a free end of which a collar extends, wherein a surface of the collar facing the neck region engages behind a support surface formed in the guide track.

2. The device of claim 1, wherein a distance of the connecting stub projecting from the flat bearing region of the item to mutually opposite longitudinal edges of the item is equal.

3. The device of claim 1, wherein side edges of a curved path of the guide track connecting ends of the guide track to each other have respective support surfaces.

4. The device of claim 1, wherein a plurality of spaced-apart support webs aligned perpendicularly to the plane of the bearing surfaces of the item and the carrier panel and having a respective support surface are integrally formed on inner edges of the ends of the guide track.

5. The device of claim 3, wherein at least one spring tongue is integrally formed on each of the inner edges of the ends of the guide track and are pressable under action of force in a direction of the guide track edge from a latching position narrowing a passage width of the guide track, wherein the spring tongue, as viewed perpendicularly to the plane of the bearing surfaces of the item and carrier panel, is integrally formed at a level of the cylindrical neck region of the connecting stub.

6. The device of claim 3, wherein the curved path of the guide track is curved in only one direction.

7. The device of claim 6, wherein the ends of the guide track are curved in a transition to the curved path against a curvature of the curved path.

8. The device of claim 1, wherein the rolling-contact bodies are accommodated in a rolling-contact body cage having a plurality of rolling-contact body receptacles.

9. The device of claim 8, wherein the rolling-contact body cage comprises an annular closed frame region and a support region, wherein the frame region does not extend beyond an edge of the carrier panel in all positions of the item from the starting position to the end position and the support region extends beyond an edge of the carrier panel within a predetermined pivot angle range.

10. The device of claim 1, wherein the item is a shelf with a depositing surface.

11. A piece of furniture or household appliance, comprising:

a body; and a device mounted on the body, wherein the device comprises a carrier panel having a bearing region;

an item configured for translatory and rotary movement, wherein the item has a flat bearing region relative to the bearing region of the carrier panel, wherein the bearing region of the carrier panel is arranged plane-parallel to the flat bearing region of the item, wherein the flat bearing region of the item and the bearing region of the carrier panel have mutually facing bearing surfaces, wherein, as viewed in a plane of the bearing surfaces of the item and the carrier panel, a length of the item is greater than a width of the item, wherein the mutually facing bearing surfaces of the bearing regions of the item and carrier panel have respective running channels in which rolling-contact bodies are guided, wherein the running channels are formed in such a way that when force is applied to the item in a direction defined in the plane of the bearing regions of the item and the carrier panel, the item is moveable relative to the carrier panel in a first pivoting direction from a starting position into an end position, in which the item is pivoted relative to the carrier panel through a predetermined angle between 90° and 180° and is pivotable back into the starting position in a second pivoting direction, which is opposite to the first pivoting direction, wherein a connecting stub projects from one of the bearing regions of the item and the carrier panel and is movable in a guide track arranged in the other of one of the bearing regions of the item and the carrier panel, wherein the connecting stub is arranged eccentrically on the one of the bearing regions from which it projects, wherein the guide track forms a curve with a varying radius of curvature, and wherein the connecting stub has a cylindrical neck region, from a free end of which a collar extends, wherein a surface of the collar facing the neck region engages behind a support surface formed in the guide track.

12. The piece of furniture or household appliance of claim 11, wherein the piece of furniture or household appliance is a refrigerator or freezer.

* * * * *